US011761179B2

(12) United States Patent
Rudolph

(10) Patent No.: US 11,761,179 B2
(45) Date of Patent: Sep. 19, 2023

(54) BATHTUB/SHOWER ARRANGEMENT, AND USE OF A BATHTUB/SHOWER ARRANGEMENT

(71) Applicant: Neoperl GmbH, Mullheim (DE)

(72) Inventor: Jorg Rudolph, Neuenburg (DE)

(73) Assignee: NEOPERL GMBH, Mullheim (DE)

( * ) Notice: Subject to any disclaimer, the term of this patent is extended or adjusted under 35 U.S.C. 154(b) by 50 days.

(21) Appl. No.: 17/004,291

(22) Filed: Aug. 27, 2020

(65) Prior Publication Data

US 2021/0071397 A1 Mar. 11, 2021

(30) Foreign Application Priority Data

Sep. 10, 2019 (DE) ..... 202019105001.2

(51) Int. Cl.

| | |
|---|---|
| ***E03C 1/01*** | (2006.01) |
| ***E03C 1/02*** | (2006.01) |
| ***E03C 1/04*** | (2006.01) |
| ***A47K 3/02*** | (2006.01) |
| ***A47K 3/28*** | (2006.01) |

(52) U.S. Cl.

CPC ..... *E03C 1/01* (2013.01); *E03C 1/023* (2013.01); *E03C 1/025* (2013.01); *E03C 1/0408* (2013.01); *A47K 3/02* (2013.01); *A47K 3/285* (2013.01); *E03C 2201/30* (2013.01)

(58) Field of Classification Search

CPC . E03C 1/01; E03C 1/023; E03C 1/025; E03C 1/0408; E03C 2201/30; A47K 3/02; A47K 3/285

USPC ..... 4/552, 567, 570, 601, 617, 620, 663

See application file for complete search history.

(56) References Cited

U.S. PATENT DOCUMENTS

2009/0211021 A1 8/2009 Gabriele

FOREIGN PATENT DOCUMENTS

| | | | |
|---|---|---|---|
| DE | 202005012943 U1 * | 12/2005 | ..... E03C 1/0408 |
| DE | 102008064363 | 8/2009 | |
| DE | 202014101920 U1 * | 6/2014 | ..... E03C 1/04 |

OTHER PUBLICATIONS

Schwalleinlauf fur die Wanne—Detail—Magazine, Swarm run for the tub, 2 pages, https://www.detail.de/artikel/schwalleinlauf-fuer-die-wanne-4237, Nov. 2, 2011.

* cited by examiner

*Primary Examiner* — Tuan N Nguyen
(74) *Attorney, Agent, or Firm* — Volpe Koenig

(57) ABSTRACT

A bathtub/shower arrangement (1) having a bathtub (2), a bathtub inlet (3), a shower head (4) and a switchover valve (5), by way of which switchover valve a water flow (6) is able to be switched between the bathtub inlet (3) and the shower head (4). The bathtub inlet (3) is arranged above the bathtub (2) at a first distance (7) from an upper edge (9) of the bathtub (2), and the shower head (4) is arranged at a second distance (8) above the bathtub (2) from the upper edge (9) of the bathtub (2), at least the first distance (7) is greater than the height (11) of a side wall (10) of the bathtub (2).

15 Claims, 5 Drawing Sheets

BATHTUB/SHOWER ARRANGEMENT, AND USE OF A BATHTUB/SHOWER ARRANGEMENT

INCORPORATION BY REFERENCE

The following documents are incorporated herein by reference as if fully set forth: German Patent Application No. 10 2019 105 001.2, filed Sep. 10, 2019.

TECHNICAL FIELD

The invention relates to a bathtub/shower arrangement having a bathtub, having a bathtub inlet, having a shower head and having a switchover means, by way of which switchover means a water flow is able to be switched between the bathtub inlet and the shower head, wherein the bathtub inlet is arranged at a first distance from an upper edge of the bathtub, and wherein the shower head is arranged at a second distance from an upper edge of the bathtub.

The invention also relates to the use of a bathtub/shower arrangement of the type mentioned in the introduction for admitting water into a bathtub.

BACKGROUND

Bathtub/shower arrangements of the type mentioned in the introduction correspond to the conventional configuration of the majority of bathtub/shower arrangements worldwide.

Generally, the outflow devices of already known bathtub/shower arrangements are arranged a few centimeters above the upper edge of the bathtub. A bathtub inlet of such an outflow device therefore projects into the space in which the user of a bathtub/shower arrangement is situated. Thus, a situation may arise in which a user knocks against the fitting or, while bathing, leans against the bathtub inlet, this being perceived as unpleasant in both cases.

SUMMARY

The object is therefore to improve the usage characteristics of bathtub/shower arrangements of the type mentioned in the introduction.

This object is achieved by a bathtub/shower arrangement having ore or more of the features described herein.

In particular, a solution provided according to the invention is a bathtub/shower arrangement of the type mentioned in the introduction, which is distinguished by the fact that the first distance and/or the second distance are/is in each case greater than the height of a side wall of the bathtub. Specifically when two users take a bath at the same time, it is often the case that the bathtub inlet is attached in such an unfavorable manner that at least one of the two users does not find a comfortable bathing position. The configuration according to the invention has the advantage that the bathtub inlet, in particular a fitting, is arranged spaced apart from the upper edge of the bathtub to a significantly greater extent, such that a user of the bathtub who is taking a bath cannot inadvertently lean against the bathtub inlet or knock against the latter. The bathtub inlet is thus arranged outside the region in which a user is situated when he or she takes a bath.

As an alternative or in addition to the features of the preceding paragraph, the aforementioned object may be achieved in that no bathtub inlet is arranged in a region from the upper edge of the bathtub to a point above the upper edge of the bathtub, which point is arranged at a distance corresponding to the height of a or the side wall of the bathtub. This corresponds approximately to the region in which a user moves during a bath. Thus, substantially the same advantages as already mentioned with regard to the preceding embodiment variant are obtained.

As an alternative or in addition to the features of the preceding paragraph, the aforementioned object may be achieved in that the switchover means is arranged between an upper edge of the bathtub, for example the upper edge of the bathtub that has already been mentioned above, and the bathtub inlet. It is thus possible for the user to be able to easily reach and actuate the switchover means, even in a position lying in the bathtub. Furthermore, the advantages already mentioned above are likewise obtained, since it has hitherto been unconventional for the bathtub inlet to be arranged separately from the switchover means.

Advantageous configurations of the invention will be described below, which, alone or in combination with the features of other configurations, may be optionally combined together.

The bathtub inlet and the shower head may differ for example in terms of a maximum volume flow per unit time. Here, in particular, a maximum volume flow per unit time for the bathtub inlet may be greater than a maximum volume flow per unit time for the shower head. In particular, for the bathtub inlet, a volume flow of at least 9 liters per minute is possible. For the shower head, a volume flow of less than 9 liters per minute is possible.

According to an advantageous configuration, it may be provided that a supply line for the bathtub inlet is rigid. Alternatively or additionally, it may be provided that a position of the bathtub inlet relative to the bathtub is fixedly assigned and/or unable to be varied. It is thereby possible for an inflow point of a water jet exiting the bathtub inlet to be fixed in the bathtub. This makes it possible for example to better avoid a situation in which, due to a relatively great falling height, unpleasant splashing occurs. The water jet can, for example, be oriented in such a manner that it falls onto an oblique wall region of the bathtub and splash water is thereby preferably deflected downward.

According to a further advantageous configuration, it may be provided that the first distance is greater than or equal to the second distance. Consequently, the bathtub inlet is arranged at least at the same height as the shower head or even above the latter.

In order to make possible even simpler operability of the bathtub/shower arrangement for a user, it may be provided according to a further advantageous configuration that the switchover means is arranged at a third distance from the upper edge of the bathtub, which third distance amounts to less than half the height of the side wall of the bathtub. The switchover means may thus remain at hitherto conventional positions, so as to make it easy to reach for a user lying in the bathtub.

Alternatively or additionally, it may be provided according to a further advantageous configuration that the switchover means is arranged spaced apart from the shower head. Achievement of simple accessibility of the switchover means by a user lying in the bathtub, as has already been described above, is possible by way of this feature too.

As an alternative or in addition to the aforementioned embodiment variants, the switchover means may be formed on the shower head. In this case, said switchover means may be a further switchover means or the switchover means already mentioned above.

According to a further advantageous configuration, it may be provided that the switchover means is arranged on a mixing device or in the region of a mixing device. The mixing device may be designed for example as a mixer faucet (mixer fitting). Mixing devices are used for dosing a water flow, and/or for being able to set a desired temperature through mixing of cold and hot water.

Alternatively or additionally, it may be provided according to a further advantageous configuration that the switchover means is arranged on a valve regulator, or in the region of a valve regulator, of at least one water feed line. A valve regulator may be understood as being for example a device for opening and closing at least one water feed line, such as for example a faucet and/or a single-lever mixer.

According to a further advantageous configuration, it may be provided that the bathtub inlet and the shower head have supply lines which are separate from one another. Furthermore, it may be expedient in this case if the two supply lines each branch off from a or the mixing device. In particular, a hot-water feed line and/or a cold-water feed line may lead into the mixing device.

In order to be able to achieve an arrangement of the supply lines that saves as much space as possible, it may be provided according to an advantageous refinement that the supply lines for the bathtub inlet and the shower head are integrated in a combination supply line. Here, the supply line for the bathtub inlet may be arranged, in particular arranged concentrically, within the supply line for the shower head. Alternatively or additionally, the supply line for the shower head may be arranged within the supply line for the bathtub inlet. Consequently, the installation of the bathtub/shower arrangement can be simplified in particular if supply lines are to be routed within a wall and/or a ceiling so as to be invisible as far as possible. In this case, it is consequently not necessary to create two separate slots, in particular wall slots, for the two supply lines, but rather the combination supply line can be routed quickly and easily in a slot.

According to an advantageous refinement, the bathtub may have a capacity of at least 100 liters. In particular, the bathtub may have a capacity of at least 150 liters, in particular of at least 175 liters, in particular of at least 200 liters, in particular of at least 250 liters, in particular of at least 300 liters. Alternatively or additionally, a height, measured from the base of an interior space of the bathtub, of a side wall to an upper edge of the bathtub may amount to at least 200 mm, in particular at least 250 mm, in particular at least 300 mm, in particular at least 350 mm, in particular at least 400 mm. A maximum filling height of the bathtub (in particular defined by a bathtub outlet formed in the side wall) may amount to at least 160 mm, in particular at least 180 mm, in particular at least 200 mm, in particular at least 220 mm, in particular at least 240 mm, in particular at least 255 mm, in particular at least 260 mm, in particular at least 280 mm.

According to an advantageous refinement, the bathtub inlet and/or the shower head may be arranged on or in a ceiling above the bathtub. It is thereby possible for particularly simple fixing of an inflow point, in the bathtub, of the water jet flowing out of the bathtub inlet and/or out of the shower head to be realized.

According to a further advantageous configuration, it may be provided that the supply line for the bathtub inlet and/or the supply line for the shower head are/is routed in a room wall. It is thereby possible for a major part of the lines of the bathtub/shower arrangement to be routed so as to be invisible to the user.

In order to be able to avoid as well as possible splash water formation from a water jet flowing out of the bathtub inlet, the bathtub inlet may have a jet former, which forms an unwidened and/or laminar jet form.

Also, in order to be able to avoid even better splash water formation from a water jet flowing out of the bathtub inlet, the water jet exiting the bathtub inlet may be oriented vertically and/or fall vertically into the bathtub.

The aforementioned object is also achieved by the use of a bathtub/shower arrangement as described and/or claimed herein for admitting water into a bathtub, wherein a user at least 1.60 meters in height, in particular at least 1.70 meters in height, in particular at least 1.80 meters in height, standing upright within the bathtub can hold his or her head under the bathtub inlet. It is thereby not possible for a user to stand up in the bathtub of the bathtub/shower arrangement and inadvertently knock his or her head against the in particular rigid bathtub inlet and, in the worst case, be injured.

BRIEF DESCRIPTION OF THE DRAWINGS

The invention will now be described in more detail on the basis of several exemplary embodiments, but is not restricted to these exemplary embodiments. Further exemplary embodiments emerge from the combination of the features of individual or several claims with one another and/or with individual or several features of the exemplary embodiments.

In the Figures.

DETAILED DESCRIPTION

Figure 1:
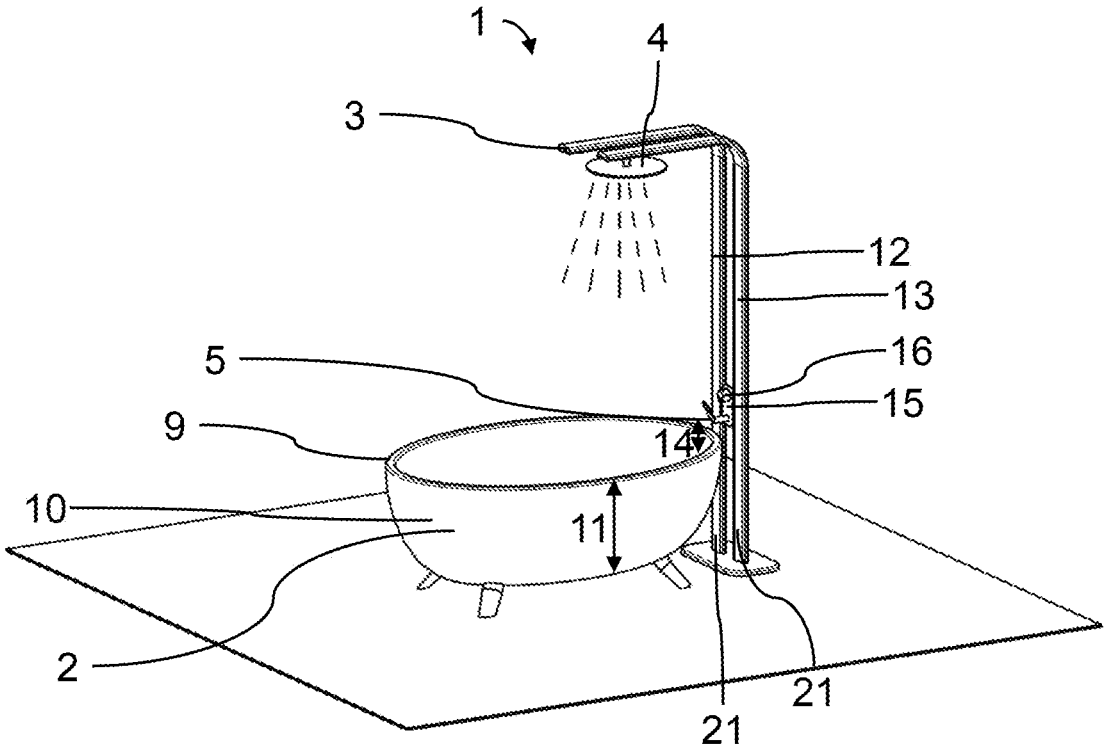
FIG. 1 shows a first possible embodiment variant of a bathtub/shower arrangement according to the invention, wherein the bathtub inlet and the shower head are arranged above the bathtub approximately equidistantly from an upper edge of the bathtub, wherein the bathtub/shower arrangement is in operation as a shower.
Figure 2:
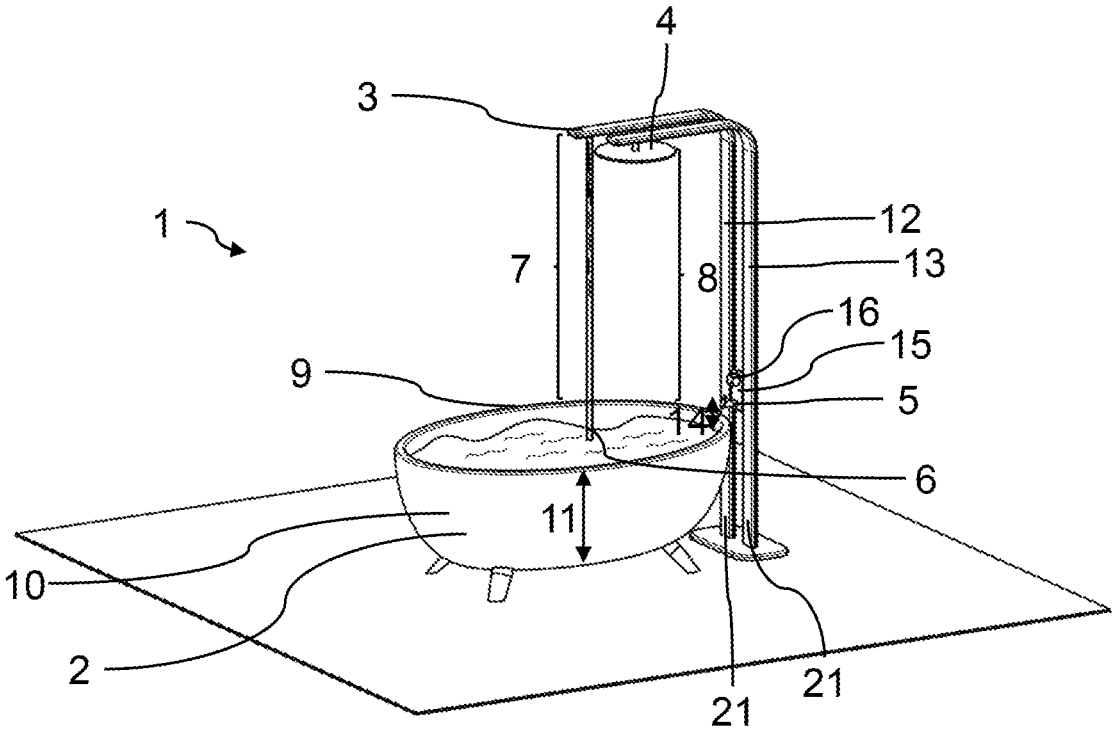
FIG. 2 shows the first possible embodiment variant of a bathtub/shower arrangement according to the invention from FIG. 1, wherein this is in operation as a bathtub.
Figure 3:
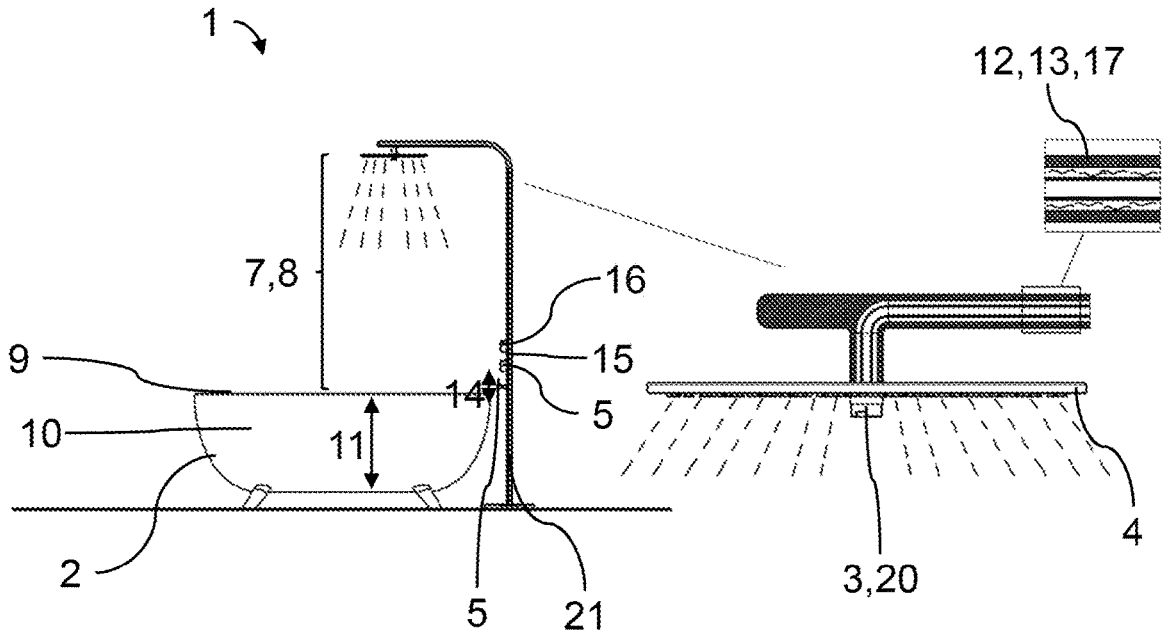
FIG. 3 shows a second possible embodiment variant of a bathtub/shower arrangement according to the invention, wherein the bathtub inlet and the shower head are arranged above the bathtub equidistantly from an upper edge of the bathtub, wherein the bathtub inlet and the shower head are integrated in an outflow device, wherein the bathtub/shower arrangement is in operation as a shower.
Figure 4:
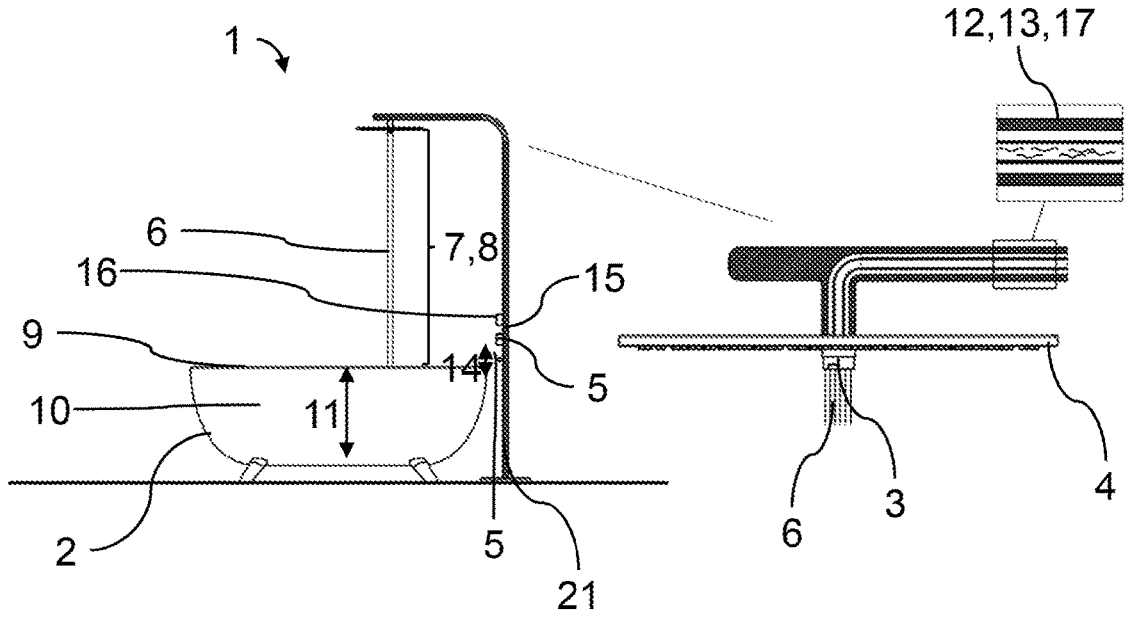
FIG. 4 shows the second possible embodiment variant of a bathtub/shower arrangement according to the invention from FIG. 3, wherein this is in operation as a bathtub.
Figure 5:
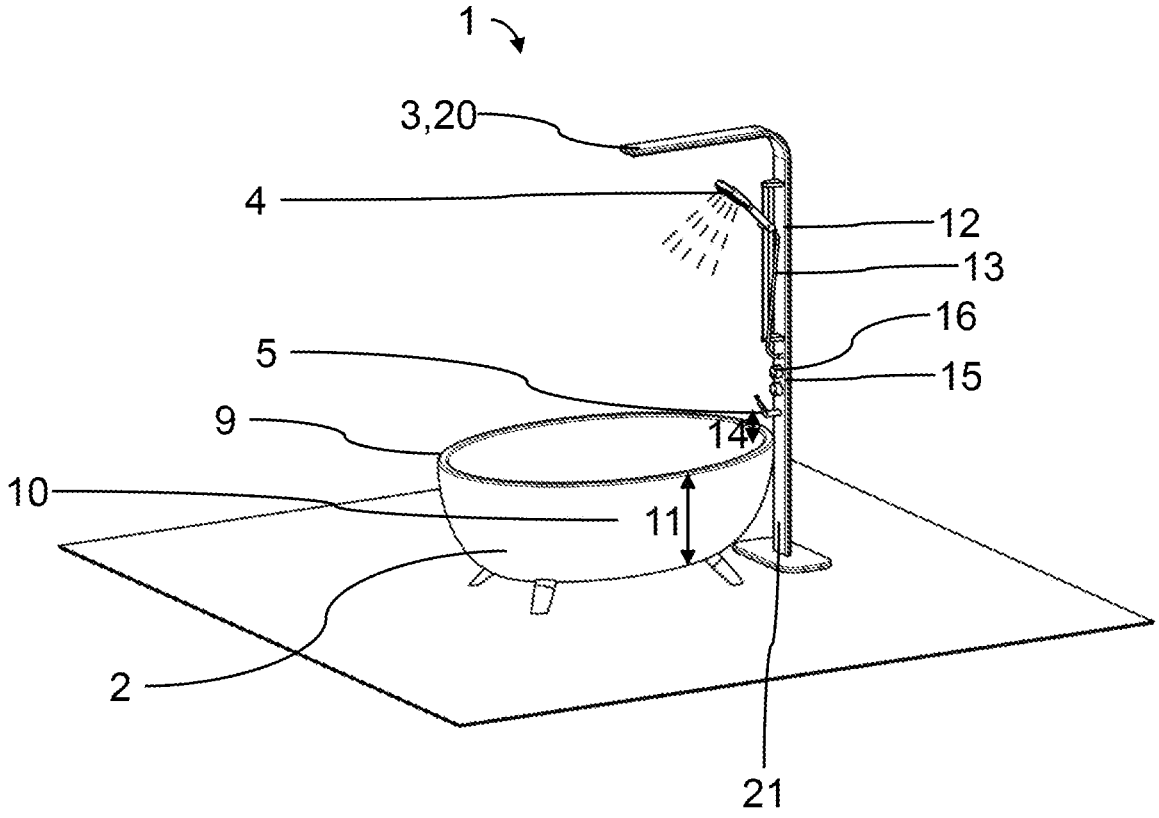
FIG. 5 shows a third possible embodiment variant of a bathtub/shower arrangement according to the invention, wherein the bathtub inlet is arranged above the bathtub above the shower head and thus at a greater distance from an upper edge of the bathtub than the shower head, wherein the bathtub/shower arrangement is in operation as a shower.
Figure 6:
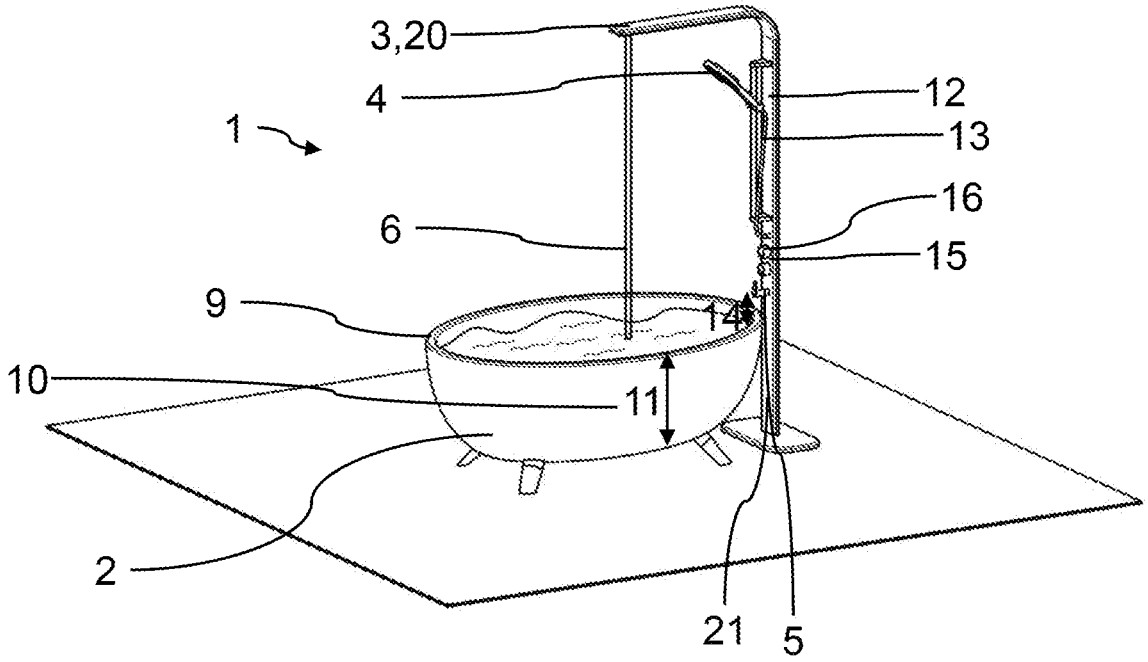
FIG. 6 shows the third possible embodiment variant of a bathtub/shower arrangement according to the invention from FIG. 5, wherein this is in operation as a bathtub.

FIGS. 1 to 10 show various embodiment variants of a bathtub/shower arrangement according to the invention, which is in each case denoted as a whole by 1. The common features and differences of the various embodiment variants will be discussed in more detail below.

Each bathtub/shower arrangement 1 from FIGS. 1 to 10 has in each case one bathtub 2, one bathtub inlet 3 for filling the bathtub and one shower head 4 for showering in the bathtub 2. A water flow can be switched between the bathtub inlet 3 and the shower head 4 with the aid of a switchover means 5 such as a valve with an actuator. The setting options can thus provide that water exits either the bathtub inlet 3 or the shower head 4. Furthermore, provision may be made of an additional setting option, in which water exits the bathtub inlet 3 and the shower head 4 at the same time.

For the purpose of defining a height within which the bathtub inlet 3 and the shower head 4 are arranged, reference is made below to an upper edge 9 of the bathtub 2, which upper edge is formed by a side wall 10 of the bathtub 2. The side wall 10 has a height 11, in particular measured from a bathtub base with respect to a vertical extent of the side wall 10.

The bathtub inlet 3 is arranged above the bathtub 2 away therefrom at a first distance 7 from the upper edge 9.

The shower head 4 is arranged above the bathtub 2 away therefrom at a second distance 8 from the upper edge 9.

The bathtub inlet 3 and the shower head 4 may differ for example in terms of a maximum volume flow per unit time. Here, in particular, a maximum volume flow per unit time for the bathtub inlet 3 may be greater than a maximum volume flow per unit time for the shower head 4. In particular, for the bathtub inlet 3, a volume flow of at least 9 liters per minute is possible. For the shower head 4, a volume flow of less than 9 liters per minute is possible.

Alternatively or additionally, the bathtub inlet 3 and the shower head 4 may differ in terms of a jet form which is formed by each of them.

The first distance 7 of the bathtub inlet 3 from the upper edge 9 may be at least as great as the second distance 8 of the shower head 4 from the upper edge 9.

For all the exemplary variants, it is the case that the first distance 7 and the second distance 8 are each greater than the height 11 of the side wall 10 of the bathtub 2.

Conventional bathtub/shower arrangements 1 have in each case only one bathtub inlet 3. As a result of this, in the configurations shown, no bathtub inlet 3 is arranged in a region from the upper edge 9 of the bathtub 2 to a point above the upper edge 9 of the bathtub 2, which point is arranged at a distance corresponding to the height of the side wall 10 of the bathtub 2.

The switchover means 5 is in each case arranged between the upper edge 9 of the bathtub 2 and the bathtub inlet 3. Consequently, despite the bathtub inlet 3 being arranged at a relatively great height, said switchover means can be easily reached and actuated by a user lying in the bathtub 2 while lying down. By contrast to conventional bathtub/shower arrangements 1, the switchover means 5 and the bathtub inlet 3 are therefore arranged at heights which differ significantly from one another, that is to say divided into functionally separate units.

The bathtub inlet 3 has a supply line 12, which leads in particular from the switchover means 5 to the bathtub inlet 3.

The shower head 4 likewise has a supply line 13, which is independent of the supply line 12 for the bathtub inlet 3 and leads in particular from the switchover means 5 to the shower head 4.

The supply line 12 for the bathtub inlet 3 may be of more rigid form than the supply line 13 for the shower head 4, as is the case for example in the configurations in FIGS. 5, 6, 7 and 8. Consequently, in these configurations, a position of the shower head 4 relative to the bathtub 2 can be varied.

By contrast, in all the embodiment variants, a position of the bathtub inlet 3 relative to the bathtub 2 is fixed and/or unable to be varied after the installation of the bathtub/shower arrangement 1. Consequently, an impingement angle of a water flow 6 flowing from the bathtub inlet 3 can be fixed by an orientation of the bathtub 2 relative to the bathtub inlet 3.

As FIGS. 1-10 show, the first distance 7 is greater than or equal to the second distance 8.

In the configurations from FIGS. 1, 2, 3, 4, 9 and 10, the first distance 7 and the second distance 8 are almost equal.

In the configurations from FIGS. 5, 6, 7 and 8, the first distance 7 is in each case greater than the second distance 8.

The switchover means 5 is in each case arranged above the bathtub 2 at a third distance 14 from the upper edge 9 of the bathtub 2. Here, the third distance 14 preferably amounts to less than half the height 11 of the side wall 10 of the bathtub 2. The third distance 14 is thus smaller than the first distance 7 and/or the second distance 8.

As FIGS. 1-10 show, the switchover means 5 may be arranged spaced apart from the shower head 4. It is also possible, however, for the switchover means 5 to be formed on the shower head 4 (not shown in the figures).

In the embodiment variants of FIGS. 1-10, the switchover means is in each case arranged on a mixing device 15 or in the region of a mixing device 15. The mixing device 15 allows a mixing ratio of cold and hot water to be set, with the result that, in this way, a desired temperature of an outflowing water flow 6 is settable. Accordingly, the mixing device 15 may be connected to a hot-water feed line and a cold-water feed line.

In the same region, in which the mixing device 15 is arranged, a valve regulator 16 for a water feed line 21 is formed too. The valve regulator 16 allows an outflowing water quantity per unit time (volume/unit time) to be set. The mixing device 15 and valve regulator 16 may preferably be combined to form a functional unit, for example in the form of a single-lever mixer.

As illustrated in FIGS. 3, 4, 9 and 10, the supply lines 12, 13 for the bathtub inlet 3 and the shower head 4 may be integrated in a combination supply line 17. Here, it may be provided that the supply line 12 for the bathtub inlet 3 is arranged within the supply line 13 for the shower head 4.

Bathtubs 2 having at least a capacity of 100 liters of water are considered to be a bathtub 2 within the context of the invention. In particular, the bathtub 2 may have a capacity of at least 150 liters, in particular of at least 175 liters, in particular of at least 200 liters, in particular of at least 250 liters, in particular of at least 300 liters.

A height 11 of the side wall 10 of the bathtub 2 from the bathtub base to the upper edge 9 of the bathtub 2 may amount to at least 200 mm, in particular at least 250 mm, in particular at least 300 mm, in particular at least 350 mm, in particular at least 400 mm.

A maximum filling height of the bathtub 2 that is defined by a bathtub outflow formed on or in the side wall 10 may amount to at least 160 mm, in particular at least 180 mm, in particular at least 200 mm, in particular at least 220 mm, in particular at least 240 mm, in particular at least 255 mm, in particular at least 260 mm, in particular at least 280 mm.

As FIGS. 7 to 10 show, at least one of the supply lines 12, 13 may be routed at least partially in a room wall 19.

A line between the switchover means 5 and the bathtub inlet 3 and/or between the switchover means 5 and the shower head 4 may be considered to be a supply line 12, 13 within the context of the invention.

Figure 7:
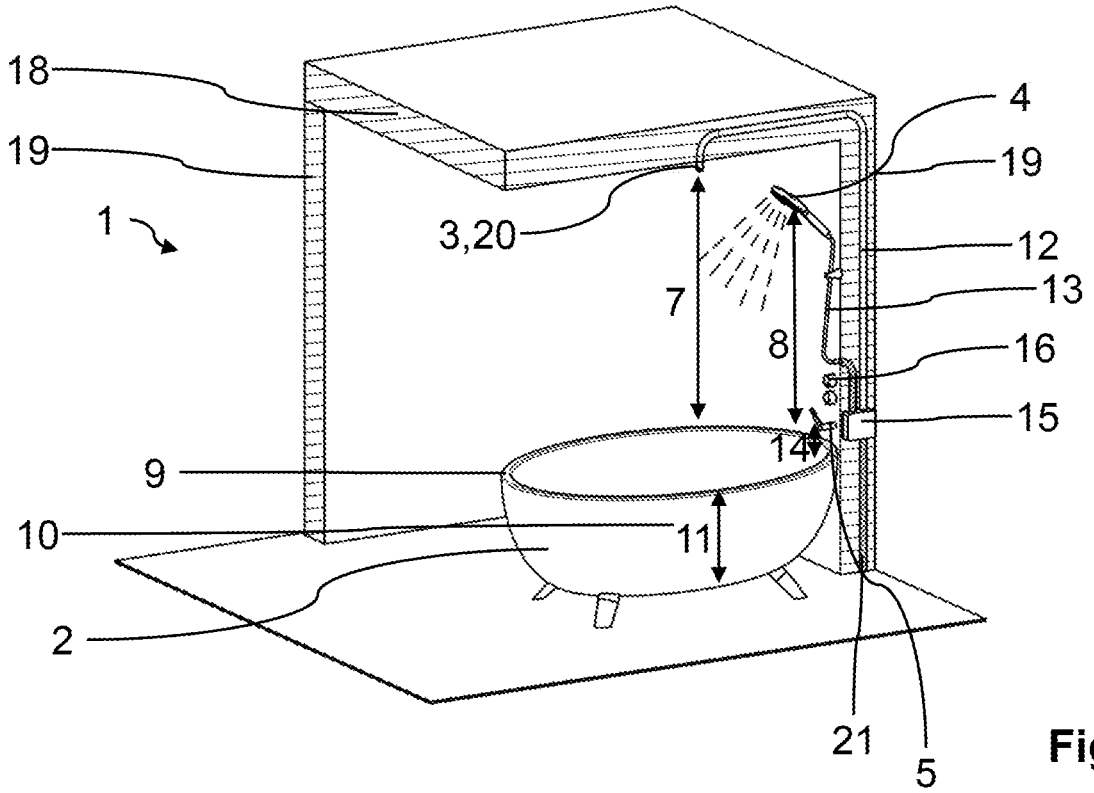
FIG. 7 shows a fourth possible embodiment variant of a bathtub/shower arrangement according to the invention, wherein the bathtub inlet is arranged above the bathtub above the shower head and thus at a greater distance from an upper edge of the bathtub, wherein the supply line for the bathtub inlet is routed in a room wall, wherein the bathtub/shower arrangement is in operation as a shower.
Figure 8:
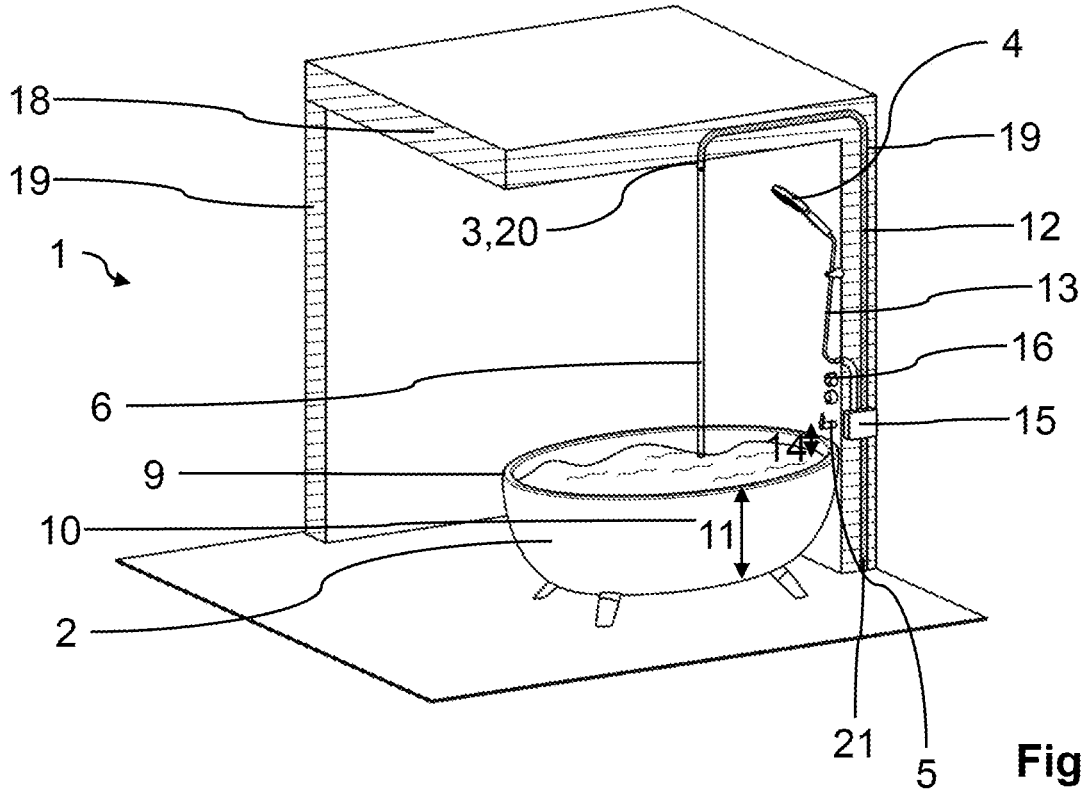
FIG. 8 shows the fourth possible embodiment variant of a bathtub/shower arrangement according to the invention from FIG. 7, wherein this is in operation as a bathtub.

In the configuration from FIGS. 7 and 8, only the supply line 12 for the bathtub inlet 3 is routed over the majority of its entire length in the room wall 19. By contrast, the supply line 13 for the shower head 4 is routed mostly outside the room wall 19. That part of the supply line 13 for the shower head 4 which is situated outside the room wall 19 may preferably be formed by a flexible hose, at the end of which the shower head 4 is attached.

Figure 9:
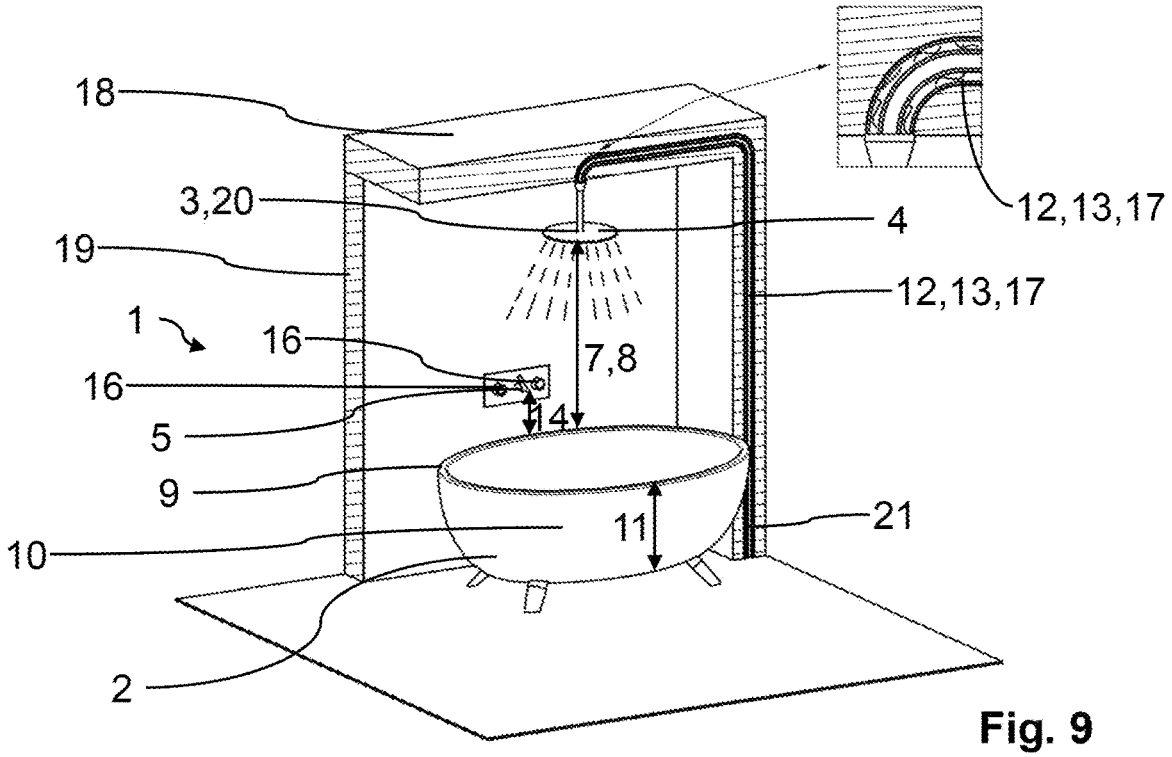
FIG. 9 shows a fifth possible embodiment variant of a bathtub/shower arrangement according to the invention, wherein the bathtub inlet and the shower head are arranged above the bathtub equidistantly from an upper edge of the bathtub, wherein the bathtub inlet and the shower head are integrated in an outflow device, wherein the supply lines for the bathtub inlet and the shower head are routed in a room wall, wherein the bathtub/shower arrangement is in operation as a shower.
Figure 10:
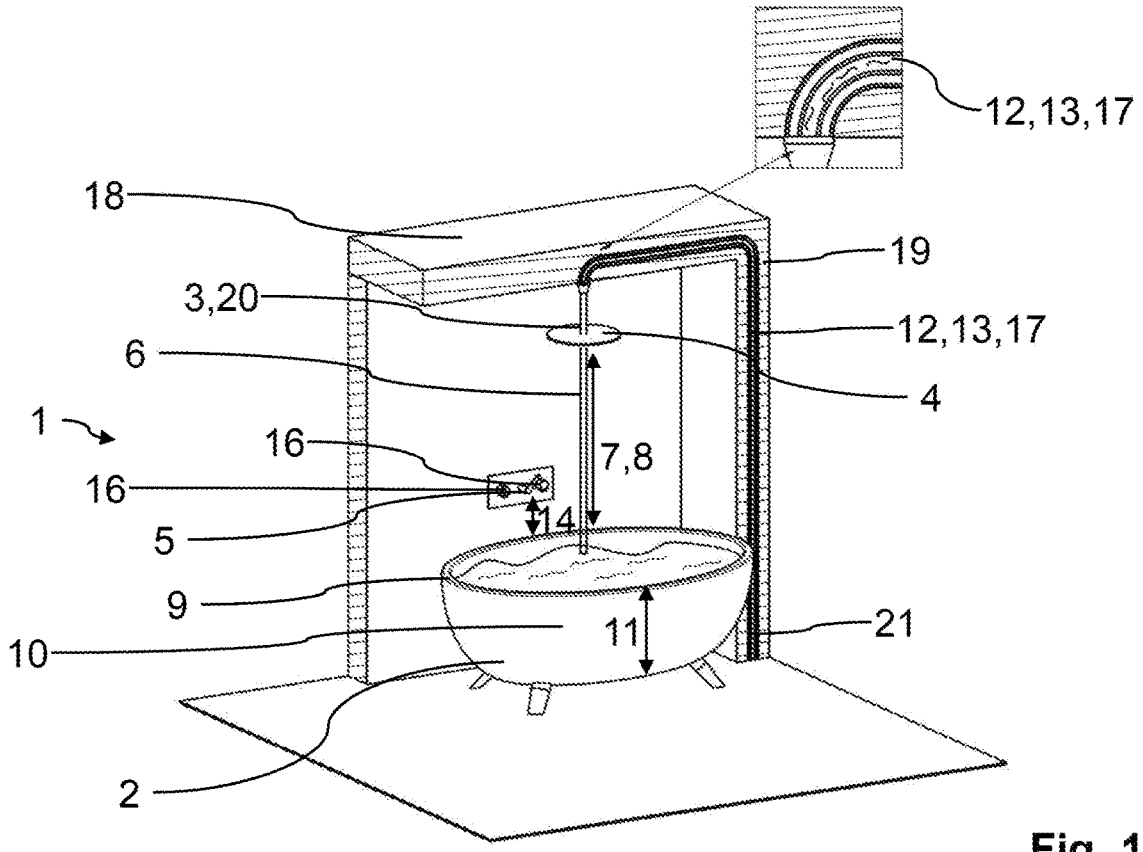
FIG. 10 shows the fifth possible embodiment variant of a bathtub/shower arrangement according to the invention from FIG. 9, wherein this is in operation as a bathtub.

In the configuration from FIGS. 9 and 10, the supply line 12 for the bathtub inlet 3 and the supply line 13 for the shower head 4 are routed over the majority of their respective entire lengths in the room wall 19.

The bathtub inlet 3 may have a jet former 20, which forms an unwidened and/or laminar jet form. In this way, formation of an excessively diffuse jet, which results in undesired formation of splash water, can be prevented more effectively. It is thus possible for example for the bathtub 2 to be used during bathing without splash protection, such as a shower curtain or shower panel.

In order to be able to further mitigate the occurrence of splash water, the water jet exiting the bathtub inlet 3 can be oriented vertically.

The invention relates in particular to a bathtub/shower arrangement 1 having a bathtub 2, having a bathtub inlet 3, having a shower head 4 and having a switchover means 5, by way of which switching means a water flow 6 is able to be switched between the bathtub inlet 3 and the shower head 4, wherein the bathtub inlet 3 is arranged above the bathtub 2 at a first distance 7 from an upper edge 9 of the bathtub 2, and wherein the shower head 4 is arranged at a second distance 8 above the bathtub 2 from the upper edge 9 of the bathtub 2, wherein at least the first distance 7 is greater than the height 11 of a side wall 10 of the bathtub 2.

LIST OF REFERENCE SIGNS

1 Bathtub/shower arrangement
2 Bathtub
3 Bathtub inlet
4 Shower head
5 Switchover means
6 Water flow
7 First distance
8 Second distance
9 Upper edge
10 Side wall
11 Height of the side wall
12 Supply line for the bathtub inlet
13 Supply line for the shower head
14 Third distance
15 Mixing device
16 Valve regulator
17 Combination supply line
18 Ceiling
19 Room wall
20 Jet former
21 Water feed line

The invention claimed is:

1. A bathtub/shower arrangement (1), comprising:
a bathtub (2),
a bathtub inlet (3),
a shower head (4), and
a switchover valve (5), configured to switch a water flow (6) between the bathtub inlet (3) and the shower head (4),
the bathtub inlet (3) is arranged at a first distance (7) from an upper edge (9) of the bathtub (2), and the shower head (4) is arranged at a second distance (8) from the upper edge (9) of the bathtub (2), and
at least one of the first distance (7) or the second distance (8) is in each case greater than a height (11) of a side wall (10) of the bathtub (2), and the first distance (7) amounts to at least ½ of the second distance (8), wherein the bathtub inlet (3) comprises a jet former (20), which forms an unwidened, laminar water jet exiting therefrom, and wherein the water jet exiting the bathtub inlet (3) is at least one of oriented vertically or falls vertically into the bathtub (2).

2. The bathtub/shower arrangement (1) as claimed in claim 1, wherein a supply line (12) for the bathtub inlet (3) is rigid, and a position of the bathtub inlet (3) relative to the bathtub (2) is fixed.

3. The bathtub/shower arrangement (1) as claimed in claim 1, wherein the first distance (7) is greater than or equal to the second distance (8).

4. The bathtub/shower arrangement (1) as claimed in claim 1, wherein an actuator of the switchover valve (5) is arranged at a third distance (14) from the upper edge (9) of the bathtub (2), said third distance is less than a height of a side wall (10) of the bathtub.

5. The bathtub/shower arrangement (1) as claimed in claim 1, wherein the switchover valve (5) is arranged spaced apart from the shower head (4).

6. The bathtub/shower arrangement (1) as claimed in claim 1, wherein an actuator of the switchover valve (5) is formed on the shower head (4).

7. The bathtub/shower arrangement (1) as claimed in claim 1, wherein the switchover valve (5) is arranged on a mixing device (15) or in the region of a mixing device (15).

8. The bathtub/shower arrangement (1) as claimed in claim 1, wherein the switchover valve (5) is arranged on a valve regulator (16), or in a region of a valve regulator (16), of at least one water feed line (21).

9. The bathtub/shower arrangement (1) as claimed in claim 1, wherein the bathtub inlet (3) and the shower head (4) have supply lines (12, 13) which are separate from one another, and at least one of a hot-water feed line or a cold-water feed line lead into the mixing device (15).

10. The bathtub/shower arrangement (1) as claimed in claim 9, wherein the supply lines (12, 13) for the bathtub inlet (3) and the shower head (4) are integrated in a combination supply line (17), and the supply line (12) for the bathtub inlet (3) is arranged within the supply line (13) for the shower head (4) or the supply line (13) for the shower head (4) is arranged within the supply line (12) for the bathtub inlet (3).

11. The bathtub/shower arrangement (1) as claimed in claim 1, wherein the bathtub (2) has a capacity of at least 100 liters.

12. The bathtub/shower arrangement (1) as claimed in claim 1, wherein at least one of the bathtub inlet (3) or the shower head (4) is arranged on or in a ceiling (18) above the bathtub (2).

13. The bathtub/shower arrangement (1) as claimed in claim 1, wherein at least one of a supply line (12) for the bathtub inlet (3) or a supply line (13) for the shower head (4) is routed in a room wall (19).

14. The bathtub/shower arrangement (1) as claimed in claim 1, wherein water is adapted to be dispensed from the bathtub inlet (3) into the bathtub (2) at a height at least 1.60 meters above a base of the bathtub (2).

15. A bathtub/shower arrangement (1), comprising:

a bathtub (2), a bathtub inlet (3), a shower head (4), and a switchover valve (5), configured to switch a water flow (6) between the bathtub inlet (3) and the shower head (4), the bathtub inlet (3) is arranged at a first distance (7) from an upper edge (9) of the bathtub (2), and the shower head (4) is arranged at a second distance (8) from the upper edge (9) of the bathtub (2), and the switchover valve (5) is arranged between the upper edge (9) of the bathtub (2) and the bathtub inlet (3), wherein the bathtub inlet (3) comprises a jet former (20), which forms an unwidened, laminar water jet exiting therefrom, and wherein the water jet exiting the bathtub inlet (3) is at least one of oriented vertically or falls vertically into the bathtub (2).

* * * * *